US007140986B2

(12) United States Patent
Howe

(10) Patent No.: US 7,140,986 B2
(45) Date of Patent: Nov. 28, 2006

(54) TENNIS RACQUET EQUIPPED WITH A TENNIS BALL RETRIEVER

(76) Inventor: Alice H. Howe, Rt. 2, Box 148, La Crescent, MN (US) 55947

( * ) Notice: Subject to any disclaimer, the term of this patent is extended or adjusted under 35 U.S.C. 154(b) by 0 days.

(21) Appl. No.: 10/635,873

(22) Filed: Aug. 5, 2003

(65) Prior Publication Data

US 2004/0029658 A1 Feb. 12, 2004

Related U.S. Application Data

(63) Continuation of application No. 09/655,743, filed on Sep. 6, 2000, now abandoned.

(51) Int. Cl.
*A63B 49/00* (2006.01)

(52) U.S. Cl. ..... 473/553; 473/537

(58) Field of Classification Search ..... 473/553, 473/517, 474, 524, 537; 273/DIG. 30
See application file for complete search history.

(56) References Cited

U.S. PATENT DOCUMENTS 3,874,666 A * 4/1975 Ross ..... 473/517
4,834,393 A * 5/1989 Feldi ..... 473/474
4,993,712 A * 2/1991 Urwin ..... 473/517
5,077,870 A * 1/1992 Melbye et al. ..... 24/452
6,401,997 B1 * 6/2002 Smerdon, Jr. ..... 224/414
2004/0029658 A1 * 2/2004 Howe ..... 473/553

FOREIGN PATENT DOCUMENTS

FR 2594037 * 8/1987

OTHER PUBLICATIONS

3M Scotchmate™ Industrial Fasteners, Technical Data, Mar. 1996.*

* cited by examiner

*Primary Examiner*—Raleigh W. Chiu
(74) *Attorney, Agent, or Firm*—M. Paul Hendrickson

(57) ABSTRACT

A highly specific type of hooked materials, when applied to the shoulder of a tennis racquet, have been found to tangentially hook onto the nap of a tennis ball and allow the ball to be lifted from the court. Hooked materials characterized as comprising a series of heat-treated nylon monofilament hooks in a rowed relationship (300/inch$^2$) of an average diameter of 8.5 mil, 1.91 mm mean height, 1.13 mm mean width and 0.71 mm mean hook depth are particularly effective for retrieving all common types of tennis balls.

12 Claims, 6 Drawing Sheets

TENNIS RACQUET EQUIPPED WITH A TENNIS BALL RETRIEVER

This application is a continuing application of U.S. patent application Ser. No. 09/665,743 entitled Tennis Racquet Equipped With a Tennis Ball Retriever filed on behalf of Alice H. Howe on Sep. 6, 2000 now abandoned.

FIELD OF INVENTION

The present invention relates to a retrieving device and, more particularly, to a retrieving device for attachment upon a tennis racquet so as to retrieve tennis balls therewith.

BACKGROUND OF THE INVENTION

The prior art provides a very interesting history of the arts' unsuccessful attempt to utilize Velcro®-type materials in combination with a tennis racquet to serve as a ball retriever. The purpose of such a retriever, when attached to the tennis racquet, would permit the tennis player to merely extend the tennis racquet to retrieve the tennis ball from the court. Early patents such as French Patent No, 2,594,037 by Gene Muslin theorized that a cloth wrapper with hooks including catching elements made of smooth layers of fastening retention threads attached to a tennis racquet would allow the tennis player to retrieve the ball without bending down or stooping. The French patentee disclosed numerous positions for attaching the cloth with hooks to the tennis racquet. The French patentee fails, however, to provide any enabling guidance as to what type of cloth with hooks could be utilized for this purpose. The patent literature collectively reveals that the positioning and configuration of the retrieving element upon the racquet by the French patentee would not lend itself to effective grasping and retrieval of a grounded tennis ball.

Another early patent to Peter Ross (U.S. Pat. No. 3,874,666) proposes the use of what is referred to as mid-temp Velcro®. Apparently, as indicated in the patent, the Ross retriever includes an outer surface equipped with stainless hooks which, when emplaced upon a tennis racquet, will hook onto the nap of a tennis ball. A subsequent patent, U.S. Pat. No, 4,834,393, to Joseph A. Feldi in discussing the shortcoming of the Ross retriever indicated that the stainless steel hooks as taught by U.S. Pat. No. 3,874,666 to Ross, had two major drawbacks. First, it was extremely difficult to pick up a tennis ball with the Ross system with success only in one out of five tries. The second problem was indicated that "after just a few retrievals using the standard tennis ball the ball covering becomes fuzz and no longer useful in normal play." In order to overcome this inability to effectively retrieve a tennis ball with a hooked material attached to the tennis racquet, Feldi proposed to completely alter the outer covering of the tennis ball to a nap consisting entirely of a different looped material more compatible with the hooks which, in turn, then would allow a hooked material of conventional Velcro®-type hooked fabric affixed to the end of tennis racquet to effectively pick up a tennis ball. Thus, Feldi's suggestion was change the tennis ball nap so that it could be retrieved with the conventional hooked fabric materials.

Another early patent to Steven M Schubert entitled "Racket Mounted Tennis Ball Retriever" of U.S. Pat. No. 4,210,327 makes reference to a tennis ball retriever sold under the trademark "GRAB-R" which consisted of an adhesive strip containing countless tiny hooks for adherence to the rounded frame at the head of the racquet. Schubert indicated that in order to permit the GRAB-R to retrieve the tennis ball, the tennis player must first secure the ball under the foot to keep if from scooting away and then engage the racquet retriever onto the ball and twist the racquet so as to snag the hooks into the covering pile.

Recognizing the inability for hooked fabric materials, such as Velcro® hooks, to effectively retrieve a tennis ball when attached to a flat or convex surface, the Schubert patentee, as well as many others, proposed to attach a cup-shaped retriever onto the butt end of the tennis racquet. The cup provided an internal cavity of a concave configuration conforming substantially to the configuration of the arcuate periphery of a tennis ball. By compressing the grounded tennis ball against the cup, an improved interlocking engagement of the hooked and curling looped fabrics was achieved by simply decompressing the tennis ball (i.e. lifting) which action apparently allowed the hooks and tennis pile to interlockingly intermesh onto one another. This design significantly increases the contacting surface of the hooks allowing the weak hooking efficacy of many hooks to provide sufficient attachment to lift the ball from the ground. Schubert indicates that if the fabric section is placed on the convex surface or even on a planer surface, which would be applied tangentially against the ball, the retriever would be ineffective for snagging the hooks into the piled loops of the ball and lifting the ball. Because of the increased surface exposure by cupping the ball, the ineffective hooks are numberly increased so as to enable the hooks to snaggingly engage the curly pile of the ball so it may then be lifted from the ground. The proposal by Schubert is not the most desirable way for attaching a ball-retrieving device to a tennis racquet. The handle of the tennis racquet is normally held by the tennis player. Consequently, when it is desired to retrieve a ball, the tennis player must grasp the head of the tennis racquet and then force the handle butt end and attached the tennis ball retriever against the courted tennis ball.

A somewhat similar ball-retrieving apparatus is disclosed in U.S. Pat. No. 4,993,712 to Kenneth J. Urwin. Similar to the Schubert patent, the Urwin patentee relies upon a cup-shaped gripping section of an arcuate shape conforming to the spherical shape of a tennis ball, which enables the enlarged portion of the gripping hooks to more effectively contact, attach and securely grip the tennis ball.

Another early version of a ball retriever of a cup shape for attachment to the butt end of the tennis racquet handle may be found in U.S. Pat. No. 4,114,881 to David A. Norton. The Norton patent relies upon a concave recess equipped with clip means preferably formed from a resilient material, which includes a plurality of radially extending arms. The arms are turned so as to extend in a substantially parallel relationship to the sidewalls of the receiving cup for the tennis ball. The free ends of the arms include a plurality of hook means disposed in a nap-engaging relationship to the corresponding portions of the tennis ball. The hook means are generally disclosed as teeth. The patentee alternatively mentions, but does not show, that a strip of Velcro® tape could also be used.

In summary, the prior art generally teaches that Velcro®-type hooked materials (i.e. fabric hooks) of a polymeric material construction, such as a nylon, necessitate substantial interfacial contact with the tennis ball cover in order to effectively be utilized as a ball retriever. Consequently, the prior art has taught the utilization of cup-shaped attachments to the tennis racquet which generally conform to the configuration of the tennis ball so as to provide an increased concave surface area for more effectively hooking and retaining the tennis ball. Since these cup-shaped retrieving devices are relatively bulky, they cannot be affixed to the tennis racquet head but must rather necessarily placed upon the butt end of the tennis racquet handle. The prior art consistently teaches that such hooked fabric materials are ineffective when utilized simply as a flat strip attached to the surface of the racquet rim or as an attachment upon the convex surface of the tennis racquet head. The prior art solution to the ineffectiveness of Velcro®-type fasteners is to increase the interfacing surface by designing the retriever to extensively cup the ball so that the ineffective hooks are then present in sufficient numbers to allow the ineffective hooks to lift the tennis ball.

In each of these situations, the prior art teaches that the tangential contact and use of such a retainer fails to provide a sufficient number of hooks so as to effectively grasp and retain the tennis ball. The applicant desired to utilize a hooked fabric attachment which could be removably attached to the flat or convex surfaces of the tennis racquet and allow for retrieval of the tennis ball simply by tangential contact of the tennis ball therewith. Unexpectedly, the applicant has discovered that a very narrow range of hooked fabric materials which, when attached to the tennis racquet, possess unexpectedly superior ball-retrieving efficacy notwithstanding making only tangential contact between the hooked material and the tennis ball nap. The discovery permits a lightweight, adhesively and removable ball retrieving element to be placed upon the tennis racquet head without adversely affecting the player's use of the racquet. The retriever is light in weight and does not alter the balance of the tennis racquet. When it is desired to retrieve a courted ball, the tennis player merely extends the retrieving head so as to tangentially contact the surface of the tennis ball with the retriever and tangentially hook onto the nap of the ball with the retrieving hooks and lift the tennis ball therewith The retrieving device exhibits extraordinary hooking and lifting efficacy. Simply tangential contact results in a surprisingly superior engagement efficacy upon initial contact with the tennis ball. The retrieving device has been effective upon all of the major brands of tennis balls.

SUMMARY OF THE INVENTION

It has been discovered that a highly specialized hook type of fabric derived from hook and loop fasteners, when attached to a tennis racquet, will effectively tangentially hook and lift all major brands of tennis balls. Prior hooked fabric fasteners required substantial surface area contact with tennis ball pile in order to hook and lift a tennis ball. The specialized hooks uniquely penetrate the tennis ball nap or pile, effectively hook a sufficient number of pile threads and tenaciously retain the threads in a hooking relationship while the tennis ball is lifted off the ground. The tennis player merely detaches or unfastens the tennis ball from the hook fastener, thus eliminating the need to bend over and manually retrieve the ball from the ground.

Unlike the conventional cup-shaped tennis ball retrieving attachments, the unique hooked material may be adhesively attached to a shoulder of a tennis racquet and used to tangentially contact, lift a hooked tennis ball pile and the tennis ball from the ground. Almost all hooked materials of a hook and loop fastener combination will fail to possess this unique functionality. An industrial hook fastener strap sold and distributed by the 3M Company, St. Paul, Minn. under the Scotchmate™ brand, when attached to tennis racquet shoulders and used as a ball retriever, exhibits unexpectedly superior efficacy in retrieving grounded tennis balls. Unlike most other hooked fabric attachments typically of a cup shape, the present hooked fabrics, when attached to a shoulder, will hook and lift a tennis ball upon tangential contact.

Merely tangentially contacting the tennis ball pile with the hooked fabric permits all major brands of tennis balls to be retrieved from the ground. A particularly effective tennis racquet attachment contains thicker monofilament hooks (e.g. 8.5 mm diameter) pre-shrunk to provide dimensional stability and flatness so as to tenaciously retain the hooked fibrous pile of tennis ball and permit it to be lifted from the ground. The individual hooks of the fastener are further characterized as having an average hook depth deeper in depth than most fastener hooks (e.g. 0.71 mm vs. 0.61 mm or less) to permit deeper penetration of the hooks so as to more tenaciously retain fibrous pile hooked by the hooks. Similarly, the average hook width is wider (e.g. 1.13 mm) so as to allow more space for the pile fibers hooked by the hooks. The average height of the hooks is also greater (e.g. 1.91 mm) than other hooks tested which reflects in more deeper penetration into the pile of tennis ball and greater quantum of fibrous pile to be potentially hooked and retained by the hooks. The hooked material also contains a sufficient number of individual hooks so as to effectively hook and lift all major brands of tennis balls.

DETAILED DESCRIPTION OF THE INVENTION

Figure 1:
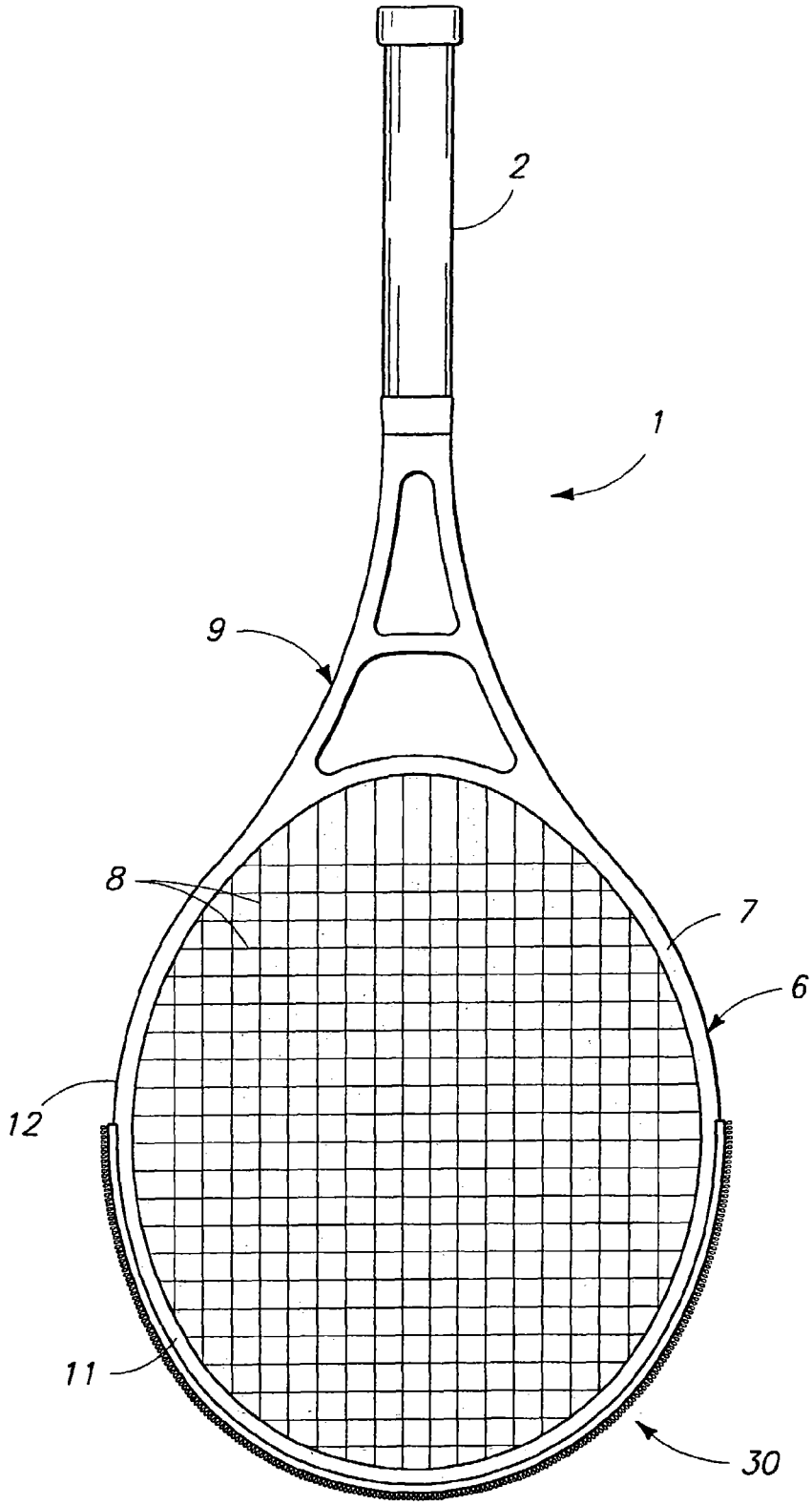
FIG. 1 depicts a tennis racquet in which a shoulder portion of the tennis racquet head is equipped with the tennis ball retriever attachments of this invention.
Figure 2A:
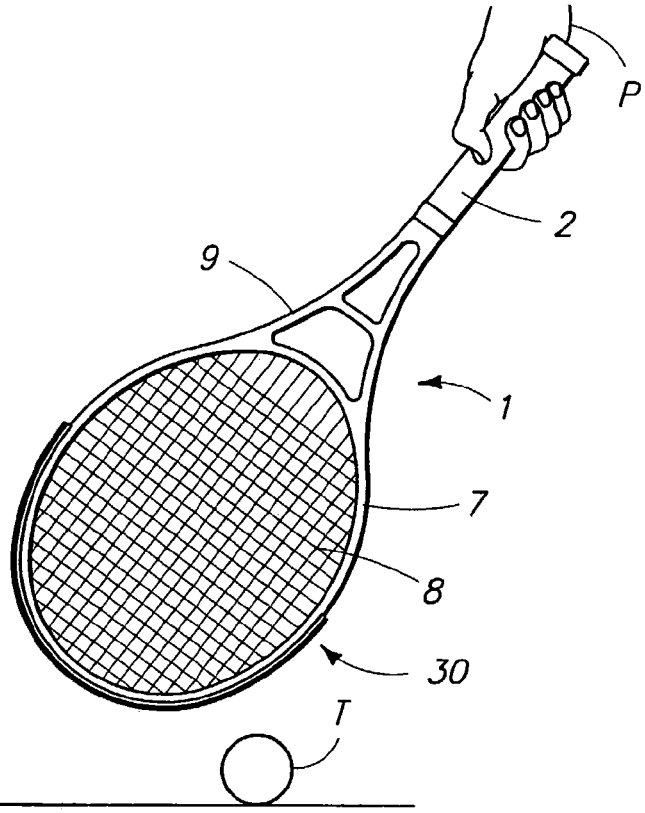
FIG. 2A depicts a view of the ball retriever shown in FIG. 1 being positioned for tangential contacting and hooking onto a tennis ball.
Figure 2B:
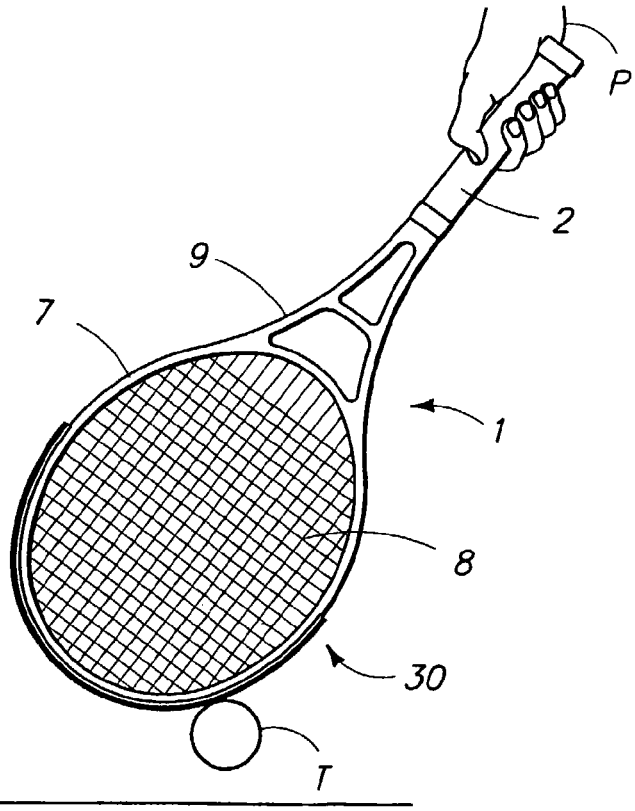
FIG. 2B depicts tangentially hooking and lifting of the hooked tennis ball with the ball retriever illustrated in FIG. 2A.

Pursuant to the present invention, there is provided a method for affixing a highly specific type of a hooked fabric material or attachment (generally referenced as a 30 series number) upon a flat or convex rimmed region or shoulder 11 of a head of a tennis racquet (generally referenced as 1) so as to permit a tennis player P to retrieve a tennis ball T upon tangentially contacting the hooked material 30 onto the tennis ball T. Unlike previous tennis ball retrieving attachments to a tennis racquet which normally required a cup-type receiving fitted with Velcro®-type material, the present invention uniquely allows the tennis ball T to be retrieved simply by tangentially contacting the nap N of the tennis ball T cover with a hooked fabric material 31 affixed to the flat or convex rimmed region 12 of a tennis racquet shoulder 11.

Similar to the frustrations encountered by prior researchers, the inventor also experienced the art-recognized shortcomings that Velcro® type of hooked fabric materials are relatively ineffective in engaging and hooking onto a tennis ball pile so as to permit its lifting therewith.

A tennis racquet 1 is generally comprised of a handle 2 for gripping the racquet 1, a head 6 which includes an oval-shaped frame 7 from which lateral strings 8 are strung vertically and horizontally across the head 6. A throat section 9 connects head 6 and frame 7 to handle 6. The outer perimeter of frame 7 of head 6 extending clockwise from the eight o'clock to the four o'clock position (handle 2 referenced at twelve o'clock) is referred to as the shoulder region 11 of the tennis racquet 1. The outwardly convex surface region 12 of shoulder 11 serves as the mounting site for the retrieving attachment 30 of this invention.

Unexpectedly, it was discovered that amongst the host of hooked fabric materials commercially available, there exists a highly select grouping of hooked fabric materials of uniquely different characteristics which permit a tennis ball T to be retrieved by tangential contact onto the tennis ball piled cover N. The discovery allows the hooked ball retriever material to be adhesively affixed upon the racquet in a position which is most effective for the tennis player's P use. Unlike the prior art teachings of placing a retrieving cup at the butt end of the handle, the present invention permits the hooked material 30 to be adhesively applied to the upper half section (preferably about the shoulder rim) of a tennis racquet head. Typically the hooked material 30 as supplied by the manufacturer is equipped with an adhesive backing 33 protectively covered with a removable plastic strip $P_c$ which, when removed, permits the hooked material 30 to be affixed to a rimmed shoulder 12 of the tennis head 6 as illustrated in FIGS. 1, 2A, 2B, 6 and 7. If desired, the removable hooked material 30 may be subsequently removed from shoulder 11 so as to permit restringing or other maintenance of racquet 1.

Figure 3:
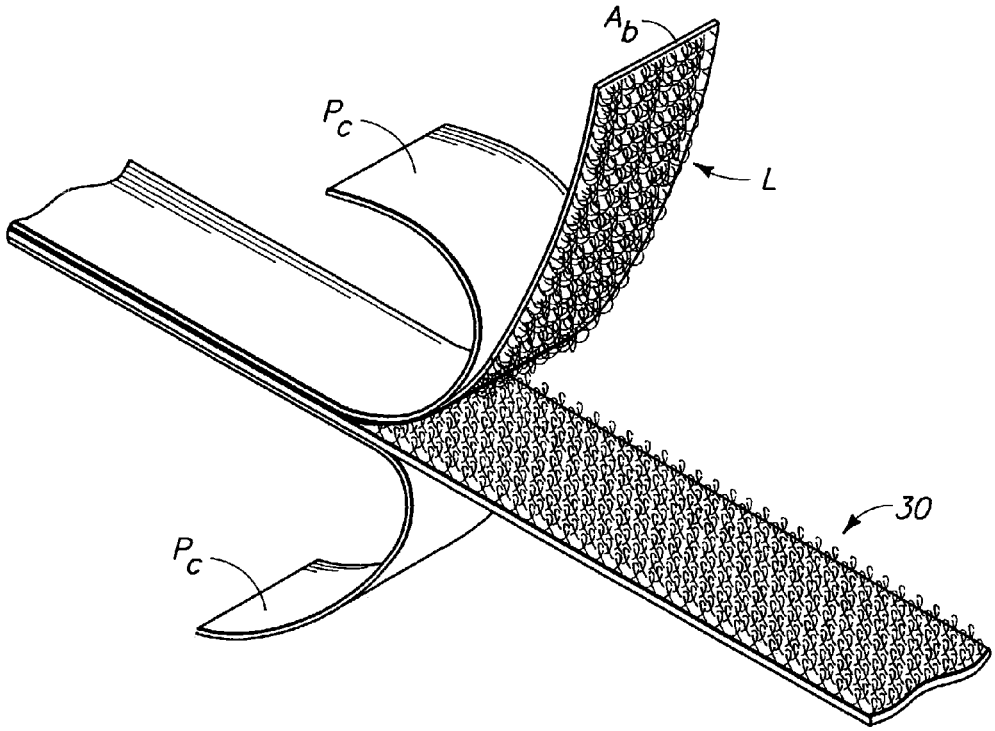
FIG. 3 illustrates a view of a hook and loop fastener material which is used as a hook source for the attachments shown in the figures.

FIG. 3 illustrates a Scotchmate™ industrial fastener SJ3526, a hook and loop industrial fastener comprised of a loop fabric material L supported by an adhesive backing $A_b$ with a plastic cover $P_c$ which, when peeled or stripped from the adhesive backing, exposes the adhesive backing member, all of which is described and not used herein. Opposite the looped material L there is illustrated in FIG. 3 a hooked nylon fabric material 30 comprised of a series of spiral nylon hooks 31 supported by fabric backing 32 and an adhesive coating 33 on an opposite side to secure the hooked nylon fabric material 30 to a shoulder region 11 of a tennis racquet 11. The adhesive backing 33 is similarly protected by a strippable plastic strip $P_c$.

Figure 6:
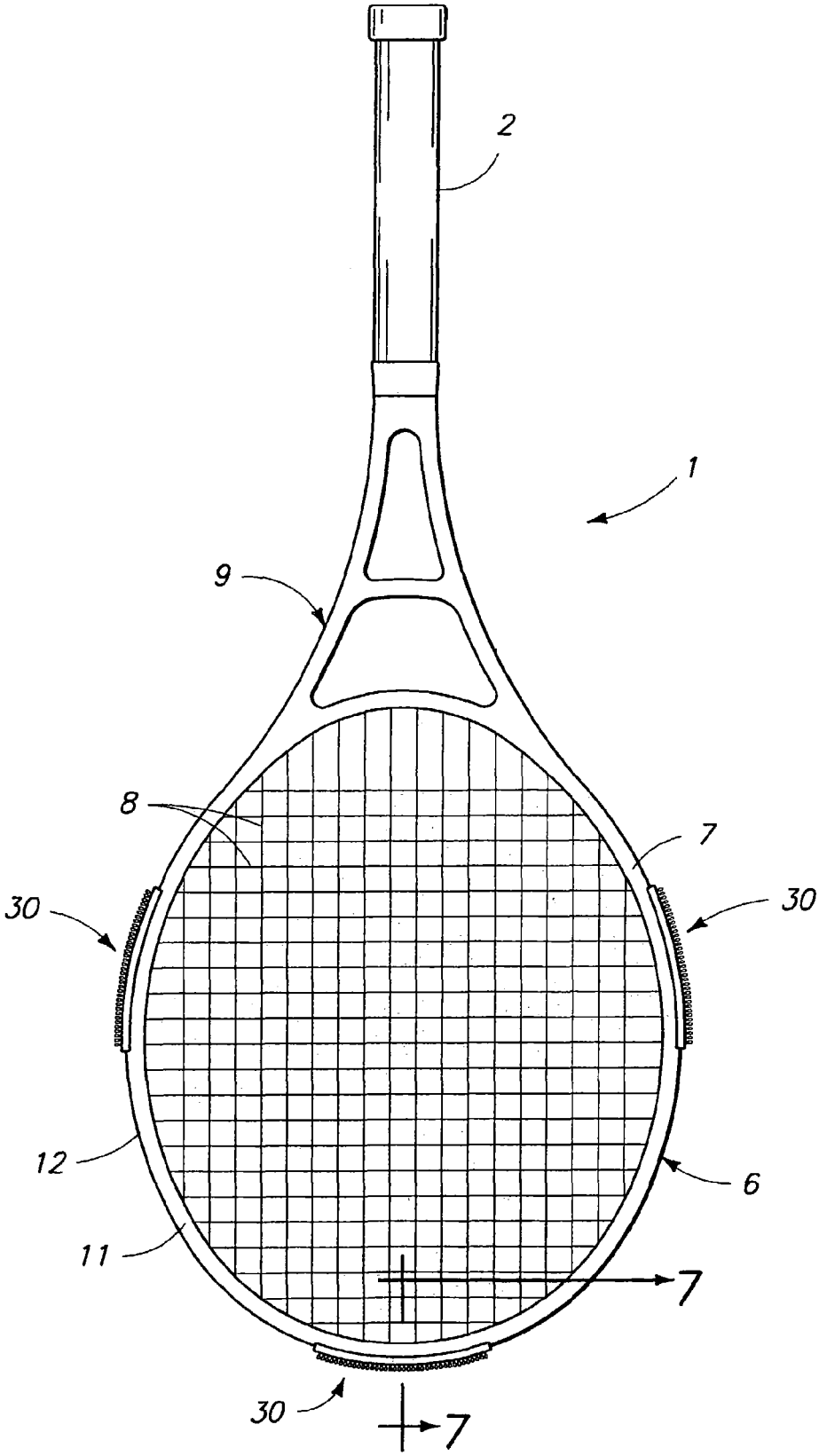
FIG. 6 depicts an alternative positioning of the ball retriever attachments upon the head of the tennis racquet.
Figure 7:
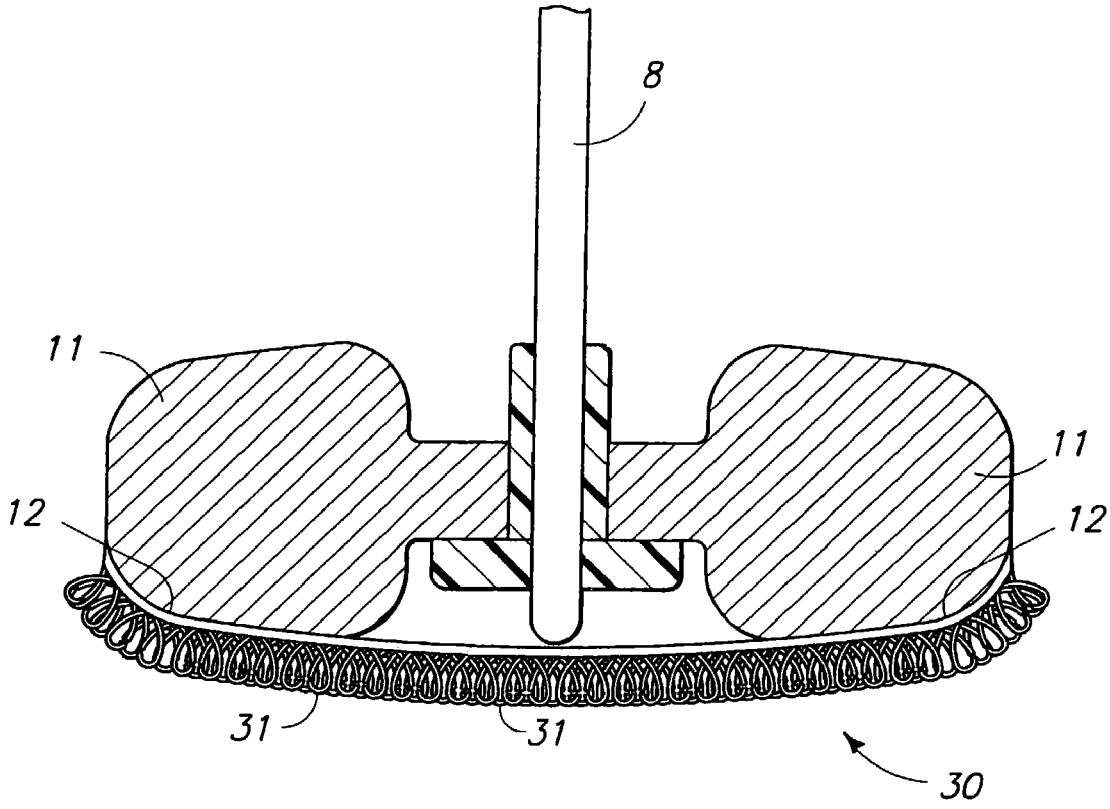
FIG. 7 is an enlarged cross-sectional view taken along line 7—7 of FIG. 6.

The preferred positioning of the hooked material 30 upon the tennis racquet 1 along the peripheral shoulder 11 margin of the racquet rim 12 is illustrated by FIGS. 1 and 6. The preferred positioning would correspond to an arc extending from the nine o'clock position to the three o'clock position relatively to the located handle 2 at a six o'clock position. The adhesively backed hooked material 30 may be emplaced entirely about the outer periphery of the racquet head 6 or partially at positions between the nine o'clock and three o'clock positioning. Although the adhesive backing 33 may be placed forwardly and rearwardly upon the flat surfaces of the shoulder 11, the hooked material 30 is placed upon a peripheral convex part of the rim 12 as shown in FIGS. 1, 2A, 2B, 6 and 7. The most preferred positioning for tangentially contacting of the ball with the tennis racquet is between ten o'clock and 2 o'clock positions.

In general, the hooked material 30 useful in this invention is derived from pre-shrunken nylon monofilaments so as to impart sufficient rigidity to the individual hooks to permit the hooks to penetrate the pile N, hook the pile loops N, and retain sufficient rigidity to maintain the hooks 31 in a hooking position and lift the tennis ball T. In general, the effective hooked materials 30 utilized herein are constructed of monofilament nylon hook 31 as depicted in FIG. 5 and characterized as having a diameter d substantially larger than most hooked fabric materials. In addition, the individual hooks 31 of the hooked material 30 will generally have an average height higher in height h than those which do not work in the invention. In addition, the average width w of the individual hooks 31 will be generally wider in width than those which do not work. In addition, the hook depth $H_d$ is also generally deeper in comparison to those Velcro® brand hooked fastener strips which fail to possess the necessary properties in order to retrieve a tennis ball upon tangential contact therewith. It has, accordingly, been unexpectedly discovered that fastener strips comprised of fabric hooked materials 30 characterized as being of significantly greater diameter d, height h, width w and depth $H_d$ will allow for the tennis ball retriever 30 of this invention to retrieve a tennis ball T simply upon tangential contact therewith as illustrates by FIGS. 2B and 4.

Figure 4:
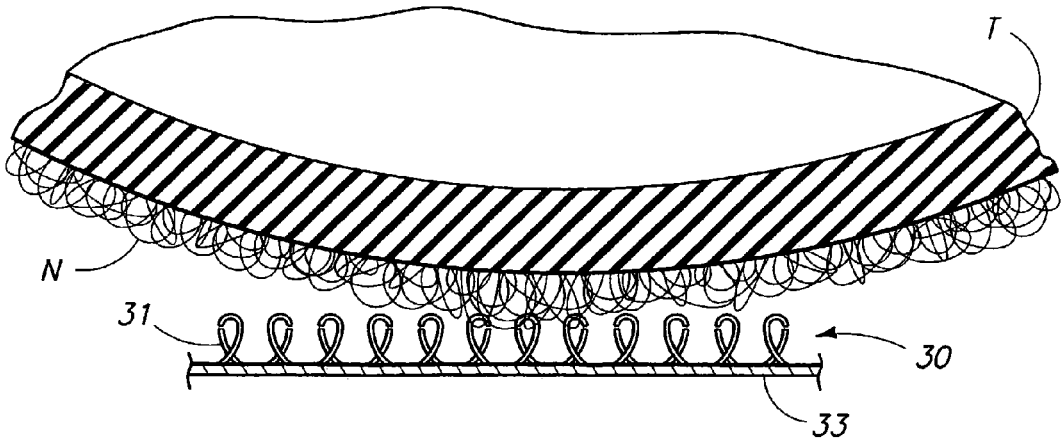
FIG. 4 is a magnified cross-sectional view depicting a single row of hooks of the hooked fabric material illustrated in FIG. 3 engaging the pile of a tennis ball.
Figure 5:
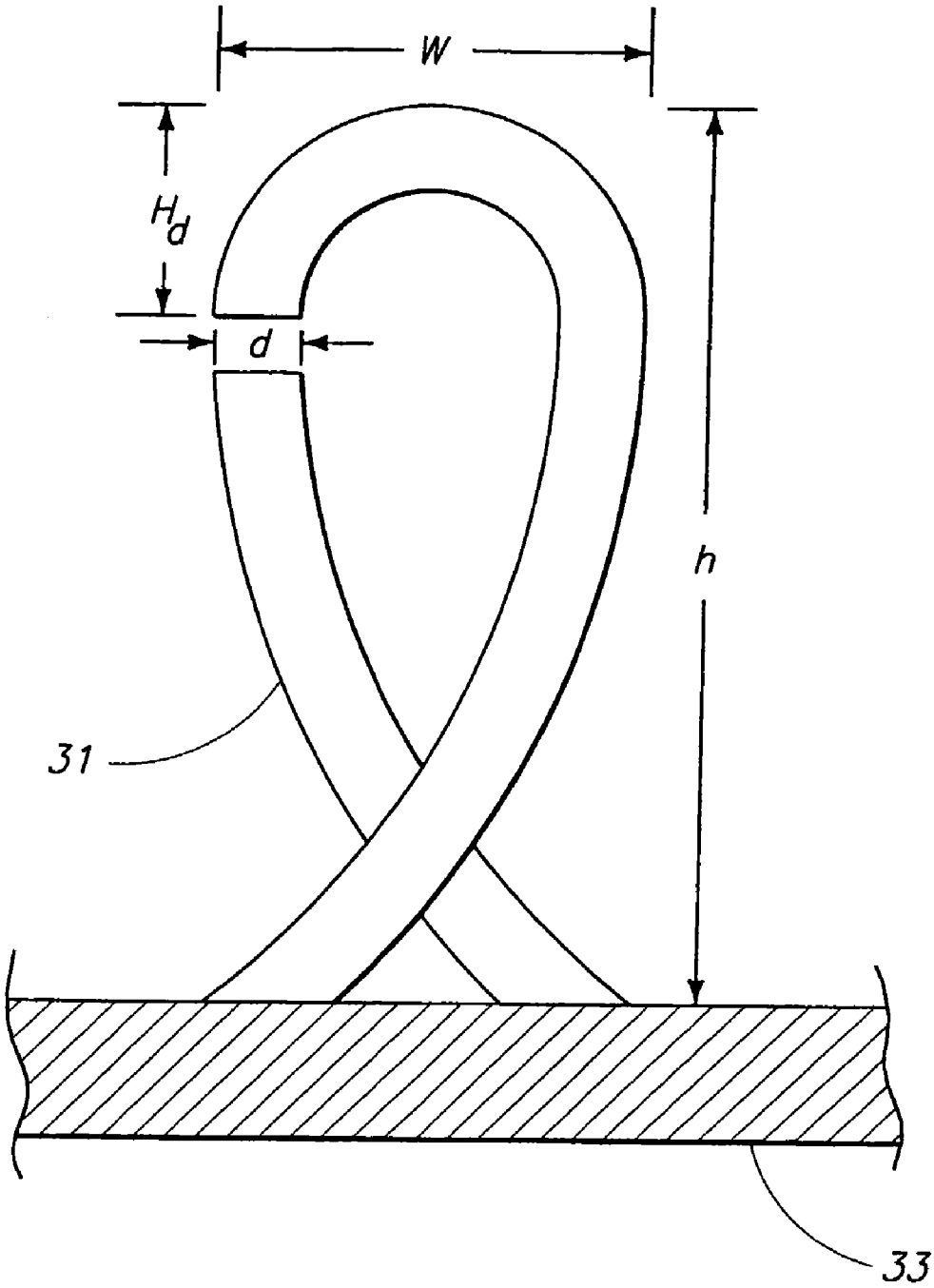
FIG. 5 is a magnified view depicting an isolated hook shown in FIG. 4.

With particular reference to FIGS. 4 and 5, the average diameter of the pre-shrunken monofilament hooks utilized herein, it has been found that an average diameter d of greater than 8.0 mil (0.008 inch), preferably at least 8.25 mil, and most preferably of at least 8.5 mil is needed in order to provide sufficient hook tenacity to retain hook 31 integrity and hold the tennis ball after hooking and during lifting. It has been found that those hooked materials 30 having hooks of an average height h less than 1.65 mm are ineffective, while those of at least 1.70 mm and advantageously greater than 1.80 mm exhibit more enhanced hooking characteristics for use herein. Particularly effective results are achieved with those hooked materials 30 having an average hook height h of at least 1.85 mm and preferably of about 1.90 mm or higher. The height of the hook in combination with thicker diameter apparently allows the hook to more deeply penetrate the pile N and more effectively hook more deeply than most conventional types of hooked materials.

The hook width w appears to also play an instrumental role in the efficacy of the hooked materials 31 herein. The wider hook dimension w in cooperative combination with the hook height h and diameter d apparently permits more individual fibers of the ball pile N to be hooked and lifted by the retrieving attachment 30 herein. The average width w of the individual hooks will advantageously be greater than about 1.0 mm and preferably greater than 1.05 mm with the average hooks having a hook width w ranging from about 1.1 mm to about 1.3 mm and being particularly adaptable herein.

As mentioned, the average depth $H_d$ of the hooked materials 30 used herein is deeper than most other materials. In general the depth $H_d$ of the hooks will typically be greater than 0.55 mm and preferably greater than 0.60 mm with an average hook depth ranging from about 0.65 mm to 0.75 mm being particularly utilizable for those purposes herein. The hook depth $H_d$ coupled with the hook diameter d plus the benefits of hook height h and width w affords apparently a more tenacious hook 31, making it difficult to dislodge the hooked pile N from the individual hooks 31.

The number of hooks 31 per square inch is not as critical to the efficacy of the material 30 as are the individual hook 31 characteristics. For example, it has been discovered that materials having more hooks per square inch do not necessarily outperform a hooked material of a lesser density, but embodied the preferred hook characteristic of the materials as described above. In general, the hooked materials used herein will typically contain more than 250 hooks per square inch and preferably of at least 300 hooks per square inch.

EXAMPLE

After it was unexpectedly discovered that a particular hooked material of a "hook and loop" fabric fastener exhibited unexpectedly superior efficacy of lifting a tennis ball upon tangential contact, a series of tests and studies were then undertaken to ascertain the efficacy of other hooked materials for this purpose. A comprehensive study was undertaken to ascertain the chemical and physical attributes contributing to this unusual phenomenon. A host of different types of hooked materials were adhesively placed to the outside rail of tennis racquet. Except for an unusual hooked material (not normally available at retail outlets), all of the hooked materials failed to exhibit any efficacy in lifting a tennis ball after tangential contact of the material with the tennis ball. After numerous failures, six different types of commercial "hook and loop" and "molded" fasteners representative of various different types of hooked materials were chosen for the test. The test included a hooked material which exhibited a lesser efficacy than the superior performer in tangentially hooking onto the nap of a tennis ball and raising the hooked ball from the ground. Weighted tests were conducted as part of this study so as to compare the efficacy between different types of hooked materials. Microscopic examinations were also conducted upon those hooked materials exhibiting a tendency to hook the nap, albeit insufficient to effectively retrieve a courted tennis ball. For test purposes, a hooked material exhibiting no hooking and lifting efficacy was included in the study.

Six types of commercial "hook and loop" and "molded" fasteners were ultimately tested to determine their ability to tangentially attach to and lift tennis balls off the ground under normal playing conditions. A six-inch strip of each type of fastener was attached to the edge of a tennis racquet head with its adhesive backing and attempts were made to retrieve various types of new balls. The types of fasteners tested in this example were as follows:

Scotchmate™ brand industrial fastener strip manufactured by 3M Company, St. Paul, Minn. and obtained from the 3M manufacturing plant in Fairmont, Minn. Specifications: 8.5 mil diameter nylon monofilament hooks at a density of over 300 per square inch. Preshrunk to provide dimensional stability and flatness. Hook dimensions: mean height—1.91 mm, mean width—1.13 mm, mean hook depth—0.71 mm.

Velcro® brand hook and loop fastener strip, type "Hook 88". Distributed by H&L Products, Inc. and purchased at Sherman Way Car Wash, Los Angeles, Calif. Specifications: 8.0 mil diameter nylon monofilament hooks at a density of over 300 per square inch. Hook dimensions: mean height—1.67 mm, mean width—1.01 mm, mean hook depth—0.51 mm.

Velcro® brand hook and loop fastener strips, type "Hook 65". Obtained from Rubenstein and Ziff, Inc., Minneapolis, Minn. Specifications: 6.5 mil diameter nylon monofilament hooks at a density of over 400 per square inch. Hook dimensions: mean height—1.37 mm, mean width—0.95 mm, mean hook depth—0.61 mm.

Velcro® brand fastener strips, type purchased at Menards stores, La Crosse, Wis. and manufactured by Velcro USA, Inc., Manchester, N.H. Specifications: unknown, except for hooks at a density of over 300 per square inch.

Velcro® brand fastener, type "MVA #8" bulk material purchased at Ace Hardware, La Crosse, Wis. Manufactured by Velcro USA, Inc., Manchester, N.H. Specifications: molded ARROWHEAD nylon hook tape with 180 hook elements per square inch.

Helping Hand PRESS-TO-LOCK adhesive strips manufactured by The Faucet Queens, Inc., Vernon Hills, Ill. and purchased at Fleet Farm stores in Winona, Minn. Specifications: nylon hooks of unknown diameter and density.

Three types of major brand name tennis balls were used in the above tests:

Wilson Championship, manufactured by Wilson Sporting Goods Co., Chicago, Ill.

Dunlop Tournament, manufactured by Dunlop Sports, Greenville, S.C.

Penn Medalist, manufactured by Penn Racquet Sports, Phoenix, Ariz.

Each of the six types of fastener strips listed above were tested to determine if they were capable of picking up tennis balls in at least two out of three consecutive attempts. Each type of fastener was tested on all three types of balls listed above, in triplicate (three separate attempts, each on a different ball). If a certain type of fastener worked, it was then further tested in triplicate to determine what amount of additional weight the retrieving strip could pick up. This was done by cutting a 2 cm. slit in each test ball and inserting pennies through the slot into the interior of the ball. Pennies were continually added and tested until the retrieving strip failed to pick up the ball two out of three times.

After each ball was tested, the coins were removed and weighed to determine the "additional weight failure" for each ball (see Table 1 attached). The raw weight of each ball was also measured and recorded so a "total pick-up weight" (see Table 1 attached) could be calculated for each ball. All weights were measured on a calibrated "Ohaus" portable electronic balance (S.N. 23365).

The following Table 1 tabulates the comparative efficacy of the Scotchmate™ and Velcro® "Hook 88", hook and loop fasteners in hooking and lifting three different kinds of commercially available tennis balls.

TABLE 1

Determination of the weights that Scotchmate ™ and Velcro ® "Hook 88" hook and loop fasteners can pick up when, attached to the edge of a tennis racquet and a tennis ball is used as the loop material.

| | | Additional Weight to Failure | | Total Pick-Up Weight | |
|---|---|---|---|---|---|
| Tennis Ball Weight | | Scotchmate | Velcro Hook #88 | Scotchmate | Velcro Hook#88 |
| Ball ID | (grams) | (grams) | (grams) | (grams) | (grams) |
| Dunlop 1 | 56.24 | 274.57 | 66.58 | 330.81 | 122.82 |
| Dunlop 2 | 56.69 | 300.98 | 94.62 | 357.67 | 151.31 |
| Dunlop 3 | 57.03 | 305.96 | 63.53 | 362.99 | 120.56 |
| Average | 56.65 | 293.84 | 74.91 | 350.49 | 131.56 |
| Std. Dev. | | | | 17.25 | 17.14 |
| Wilson 1 | 56.18 | 294.49 | 46.66 | 350.67 | 102.84 |
| Wilson 2 | 56.00 | 320.02 | 55.28 | 376.02 | 111.28 |
| Wilson 3 | 57 63 | 292.95 | 41.05 | 350.58 | 98.68 |
| Average | 56.60 | 302.49 | 47.66 | 359.09 | 104.27 |
| Std. Dev. | | | | 14.66 | 6.42 |
| Penn 1 | 55.34 | 287.97 | 49.08 | 343.31 | 104.42 |
| Penn 2 | 55.14 | 299.46 | 74.61 | 354.60 | 129.75 |
| Penn 3 | 56.33 | 66.53 | 0.00 | 121.86 | 56.33 |
| Average | 55.60 | 217.99 | 41.23 | 273.26 | 96.83 |
| Std. Dev. | | | | 131.23 | 37.29 |

Note:
Weight pick-up ability was measured by adding weight to a tennis ball until the ball could not be picked up 2 out of 3 attempts.

The following Table 2 tabulates a statistical comparison of the total hooking and lifting weights for the two tested hook and loop fasteners.

TABLE 2

Statistical comparison of Total Pick-Up Weights for Scotchmate ™ vs. Velcro ®brand "Hook #88"

| Dunlop (Scotchmate vs. Velcro) t-Test: Paired Two Sample for Means | | | Wilson (Scotchmate vs. Velcro) t-Test: Paired Two Sample for Means | | | Penn (Scotchmate vs. Velcro) t-Test: Paired Two Samples for Means | | |
|---|---|---|---|---|---|---|---|---|
| | Var. 1 | Var. 2 | | Var. 1 | Var. 2 | | Var. 1 | Var. 2 |
| Mean | 350.49 | 131.5633 | Mean | 359.09 | 104.2667 | Mean | 272.256 | 96.8333 |
| Variance | 297.55 | 293.725 | variance | 214.97 | 41.216 | Variance | 17222.5 | 1390.79 |
| Observations | 3 | 3 | Observations | 3 | 3 | Observations | 3 | 3 |
| Pearson Corr. | 0.29818 | | Pearson Corr. | 0.9470 | | Pearson Corr. | 0.95430 | |
| Hypothesized Mean D | 0 | | Hypothesized Mean D | 0 | | Hypothesized Mean D | 0 | |
| df | 2 | | df | 2 | | df | 2 | |
| t Stat | 18.6145 | | t Stat | 50.000818 | | t Stat | 3.1733897 | |
| P(T <= t) one-tail | 0.001437** | | P(T <= t) one-tail | 0.0002** | | P(T <= t) one-tail | 0.0432984** | |
| t Critical one-tail | 2.919987 | | t Critical one-tail | 2.919987 | | t Critical one-tail | 2.9199873 | |
| P(T <= t) two-tail | 0.002874 | | P(T <= t) two-tail | 0.0004 | | P(T <= t) two-tail | 0.0865968 | |
| t Critical two-tail | 4.302656 | | t Critical two-tail | 4.302656 | | t Critical two-tail | 4.3026557 | |

Note:
**P values less than 0.05 indicate a statistically significant difference between Scotchmate and Velcro Hook #88 performance.

A microscope examinations to determine the dimensions of various individual hooks of the hooked materials used in this example were also conducted. The microscopic examination included, for comparison purposes, a fastener strip that failed to pick up the balls. The hook "height", "width" and "depth" as illustrated in FIG. 5 determinations were made for each type of fastener strip by measuring the dimensions of ten randomly selected hooks under a "Reichert" Variable power dissecting microscope. A "Mitutogo" digital micrometer was used to make each measurement (S.N. 0051103). The results of this examination are tabulated in the following Table 3.

TABLE 3

Hook dimensions (mm) for Scotchmate ™ and Velcro ® brand Hook #88 and #65 fastener strips

| | Scotchmate ™ | | | Velcro ® Hook #88 | | | Velcro ® Hook #65 | | |
|---|---|---|---|---|---|---|---|---|---|
| | Height | Width | Depth | Height | Width | Depth | Height | Width | Depth |
| | 1.78 | 1.14 | 0.81 | 1.76 | 1.00 | 0.59 | 1.50 | 0.98 | 0.44 |
| | 1.80 | 0.95 | 0.58 | 1.46 | 1.07 | 0.44 | 1.46 | 1.11 | 0.38 |
| | 1.85 | 1.15 | 0.94 | 1.71 | 1.07 | 0.40 | 1.33 | 1.10 | 0.59 |
| | 1.86 | 1.11 | 0.60 | 1.67 | 1.06 | 0.44 | 1.36 | 0.85 | 0.57 |
| | 1.88 | 1.03 | 0.62 | 1.65 | 1.06 | 0.43 | 1.24 | 0.93 | 0.57 |
| | 1.94 | 1.26 | 0.59 | 1.82 | 1.04 | 0.56 | 1.40 | 0.94 | 0.71 |
| | 1.95 | 1.27 | 0.50 | 1.64 | 0.92 | 0.51 | 1.38 | 0.89 | 0.65 |
| | 1.99 | 1.20 | 0.57 | 1.60 | 0.82 | 0.58 | 1.40 | 0.91 | 0.79 |
| | 2.00 | 1.08 | 0.88 | 1.69 | 1.08 | 0.60 | 1.29 | 0.82 | 0.81 |
| | 2.01 | 1.06 | 0.97 | 1.70 | 1.00 | 0.55 | 1.31 | 0.94 | 0.59 |
| Avg. | 1.91 | 1.13 | 0.71 | 1.67 | 1.01 | 0.51 | 1.37 | 0.95 | 0.61 |
| S.D. | 0.08 | 0.10 | 0.17 | 0.10 | 0.08 | 0.08 | 0.08 | 0.10 | 0.14 |

Results

As may be observed from Tables 1 and 2, only two types of fastening hooked strips exhibited a capacity to pick up tennis balls. These fastening strips were: (1) the Scotchmate™ brand industrial fastener manufactured by 3M Company and (2) the Velcro® brand, "Hook #88" fastener strips distributed by H&L Products, Inc. and purchased at Sherman Way Car Wash, Los Angeles, Calif. Only the Scotchmate™ Industrial Fastener was capable of consistently hooking and lifting all major tennis ball brands. Additional tests were then conducted to determine the amount of additional weight each type of fastener could pick up and if one type was superior to the other. In these efficacy tests, the Scotchmate™ brand industrial fastener manufactured by 3M Company was clearly shown to be superior to the Velcro® Hook #88 fastener strips tested (see Table 1 attached). The Scotchmate™ fastener not only consistently picked up approximately three times as much weight on average as the Velcro® Hook #88, but also did so consistently with minimal failures. The Velcro® Hook #88 fastener often was found to hook and lift in only two out of three attempts, and completely failed to hook and lift the Penn ball.

Pick-up weight data for the two fasteners was analyzed statistically with a "paired t-Test for comparing two sample means" to determine if there was a significant difference in the ability of each fastener to pick up weighted balls (see Table 2 above). Data was analyzed separately for each of the three types of balls tested. These statistical tests showed that the Scotchmate™ brand industrial fastener strip was capable of picking up significantly more weight than the Velcro® Hook #88 fastener when tested upon all three of the major brands of tennis balls.

Measurements to determine the average hook height, width and depth (see FIG. 5 and Table 3 for data) of three types of fasteners (Scotchmate™, Velcro® Hook #88, and Velcro® Hook #65) revealed physical differences which singularly and collectively contribute to unexpectedly superior efficacy to hook and lift tennis balls. The Scotchmate™ industrial fastener strip was comprised of hooks with significantly greater height, width, and depth than the Velcro® Hook #88 or Hook #65 fastener strips tested (see Table 3). The average hook height, width and depth calculated for the Scotchmate™ fastener strip tested was 1.91, 1.13 and 0.71 mm., respectively. The average hook height, depth and width calculated for the Velcro® Hook #88 fastener strip tested was 1.67, 1.01, and 0.051 mm, respectively. The average hook height, width and depth calculated for the Velcro® Hook #65 fastener strip tested was 1.37, 0.095 and 0.61 mm, respectively. The average diameter of the hooks for the Scotchmate™ industrial fastener was also larger and more tenacious in retaining its hooking characteristics over other tested brands.

The Scotchmate™ brand industrial fastener strip was clearly superior to all the types of Velcro® brand hook and loop and molded fastener strips tested in its ability to consistently pick up three types of popular tennis balls when a strip of each material was attached to the edge of a typical tennis racquet. The Scotchmate™ brand industrial fastener strips have unique physical characteristics which enable them to stick to and pick up tennis balls (weighted or not) when other fastener strips cannot. Collectively, the larger diameter (and thereby probably more rigid hook material (8.5 mil), longer hooks (1.91 mm), wider hooks (1.13 mm), deeper hooks (0.71 mm), and the pre-shrinking process used in its manufacture contribute to this unexpectedly superior efficacy.

The Scotchmate™ industrial fastener is uniquely distinctive in its ability to tangentially hook and lift the Penn tennis ball. The Scotchmate™ industrial fastener is available with some hooks in three different pressure-sensitive adhesive numbers, namely SJ3526, SJ3519 and SJ3572. The pressure-sensitive adhesive backing of SJ3526 exhibited excellent adherence to tennis racquet heads of different materials of construction while also affording removability to allow for restringing or other maintenance to the head.

What is claimed is:

1. A combination of a tennis racquet equipped with a ball retrieving attachment attached to a shoulder of the racquet in a ball retrieving position for engaging and lifting a grounded tennis ball upon tangential contact with said tennis ball, said attachment consisting essentially of a hooked fastener material adhesively attached to a convex outer perimeter portion of the shoulder so as to permit the hooked fastener material to make the tangential contact with said grounded tennis ball, with said hooked fastener material having a series of pre-shrunken nylon monofilament hooks for engaging and lifting the grounded tennis ball upon the tangential contact, with said hooks being characterized as having an average hook width of at least 1.00 mm, an average hook depth of at least 0.6 mm, an average monofilament diameter greater than 8.0 mil and an average hook height of at least 1.70 mm.

2. The combination according to claim 1 wherein the average height of the hooks is at least 1.85 mm, the average diameter is at least 8.25 mil and the attachment is further characterized as containing at least 250 hooks per square inch with the series being an arrangement of repetitive rows of the hooks.

3. The combination according to claim 2 wherein the attachment comprises the hooks mounted to a rubber backing with a pressure sensitive adhesive for detachably mounting the attachment to the shoulder of the racquet.

4. The combination according to claim 3 wherein the attachment contains at least 300 hooks per square inch, the average height of the hooks is greater than about 1.90 mm, the average hook width ranges from about 1.1 mm to about 1.3 mm and the average hook depth ranges from about 0.65 mm to about 0.75 mm.

5. The combination according to claim 1 wherein the attachment is applied as a continuous strip to the shoulder of the racquet at a tennis ball retrieving position.

6. The combination according to claim 5 wherein the attachment is positioned along an outer peripheral edge of the shoulder between an eight o'clock and four o'clock position.

7. A method for retrieving a grounded tennis ball possessing a standardized felt pile nap with a tennis racquet equipped with a ball retrieving attachment attached along an outer peripheral edge of a shoulder of the tennis racquet with the hooked material positioned thereupon at a retrieving position for engaging and lifting a grounded tennis ball upon tangential contact therewith, said method consisting essentially of:

a) providing a strip of a hooked material having a pressure sensitive adhesive applied to a resilient backing member equipped with a plurality of pre-shrunken nylon monofilament hooks of an average monofilament diameter of at least 8.0 mil, an average hook height of at least 1.85 mm, an average hook width of at least 1.0 mm, and an average depth of at least 0.6mm, with the hooks being of a spiral configuration arranged in repetitive rows of at least 250 hooks per square inch;

b) applying the pressure sensitive strip to the outer peripheral edge of the shoulder of the tennis racquet at the retrieving position so as to permit the nylon monofilament hooks of the hooked material to make the tangential contact with the grounded tennis ball;

c) tangentially contacting and intermeshing the felt pile nap of the grounded tennis ball with the nylon monofilament hooks of said hooked material so as to engage and hook onto the felt pile nap of the grounded tennis ball with said nylon monofilament hooks;

d) lifting the hooked tennis ball engaged by the nylon monofilament hooks with the tennis racquet; and e) retrieving the lifted tennis ball from the strip by unhooking said monofilament hooks from the felt pile nap.

8. The method according to claim 7 wherein the method includes the applying of the strip at a contacting position between a nine o'clock to a three o'clock position of the shoulder.

9. The method according to claim 7 wherein the average monofilament diameter is at least 8.25 mil, the average height is at least 1.90 mm, the average hook ranges from about 1.1 mm to about 1.3 mm, and the average hook depth ranges from about 0.65 mm to about 0.75 mm.

10. The method according to claim 9 wherein the applying includes the applying of at least one strip positioned along the peripheral edge located from a nine o'clock position to about a three o'clock position.

11. The method according to claim 10 wherein the strip covers the nine o'clock position and the three o'clock position.

12. The method according to claim 10 wherein a continuous strip is applied to the shoulder.

* * * * *